United States Patent [19]

Hinds

[11] Patent Number: 4,588,216

[45] Date of Patent: May 13, 1986

[54] OVER-CENTER TOGGLE LATCH

[75] Inventor: Farley T. Hinds, Dayton, Ohio

[73] Assignee: The United States of America as represented by the Secretary of the Air Force, Washington, D.C.

[21] Appl. No.: 640,623

[22] Filed: Aug. 14, 1984

[51] Int. Cl.[4] ..... E05C 5/02

[52] U.S. Cl. ..... 292/113; 292/DIG. 49; 292/DIG. 60

[58] Field of Search ..... 292/113, 247, 56, DIG. 49, 292/DIG. 60, DIG. 31, 109, 114

[56] References Cited

U.S. PATENT DOCUMENTS

| | | | |
|---|---|---|---|
| 2,472,285 | 6/1949 | Claud-Mantle | 16/147 |
| 2,704,218 | 3/1955 | Claud-Mantle | 292/113 |
| 2,921,810 | 1/1960 | Smith | 292/113 |
| 3,127,205 | 3/1964 | Griffiths et al. | 292/113 |
| 3,318,624 | 5/1967 | Poe et al. | 292/113 |
| 4,181,333 | 1/1980 | Stelma | 292/113 X |
| 4,213,643 | 7/1980 | Blind et al. | 292/247 |
| 4,243,255 | 1/1981 | Hornak | 292/113 |

FOREIGN PATENT DOCUMENTS

| | | | |
|---|---|---|---|
| 32605 | 9/1927 | France | 292/113 |
| 330348 | 7/1958 | Switzerland | 292/113 |

*Primary Examiner*—Richard E. Moore

*Attorney, Agent, or Firm*—Donald J. Singer; Jacob N. Erlich

[57] ABSTRACT

Improved low profile over-center toggle latch having a latch arm with an internally threaded latch barrel nut for adjustable cooperation with a threaded latch draw bolt. The bolt is pivotally coupled to a latch handle assembly. The latter comprises projecting sidewalls and a grip end. The latch handle assembly is mounted by means of integral flanges cooperating with journals defined in a mounting stirrup, the latter being mounted on the container body.

6 Claims, 4 Drawing Figures

OVER-CENTER TOGGLE LATCH

STATEMENT OF GOVERNMENT INTEREST

The invention described herein may be manufactured and used by or for the Government for governmental purposes without the payment of any royalty thereon.

BACKGROUND OF THE INVENTION

The present invention relates to container closures, and more particularly, to a low profile over-center toggle latch.

Low silhouette adjustable latches are known in the art for use in providing adjustable latching of container closure members. In U.S. Pat. No. 4,243,255, a tension latch, embodying an over-center latching principle, includes means for adjusting the latch tension in the fully closed and latched position. The adjustment means is readily accessible through a channel-like opening formed by the latch handle. This latch handle portion contains a secondary locking mechanism which is laterally offset from the adjustment means. The locking mechanism is activated from the side of the handle for tension adjustment. However, such low silhouette arrangement is relatively complex and requires a multiplicity of cooperating elements.

In U.S. Pat. No. 3,127,205, an under-center toggle latch is disclosed for securing together cooperating members of a container. This latch comprises a sheet metal angle bracket mounted to a first member of the container and an operating handle, where a primary lever of channeled construction is mounted between sidewalls of the abovesaid bracket by means of spaced, an axially aligned pivot pin which passes through aligned hollows of the handle. The draw hook-tension bar assembly includes a hook section and a threaded rear terminal or shank section. The draw hook is mounted in a tension bar element which may be formed from a single elongated blank bent double and is provided at its center with a hinge pin loop and overlapping flanges. These flanges may be welded together and provided with complimentary outwardly curved radial sections for forming an opening which is internally threaded to receive the shank of the draw hook in a readily adjustable relation. This threaded sleeve section has slots to indicate the position of the threaded shank section of the draw hook. The pivot element is mounted on a pivot pin positioned in aligned openings at the inner end of sidewalls of the primary lever. The draw hook at its outer end engages a hook shaped keeper mounted on the second member of the closure. The hook section may be rotated to adjust the operative tension of the draw hook in a closed position. In order to engage the draw hook for closure of the container, the draw hook is mated with the hook shaped keeper while the primary lever is rotated in direction of the hook shaped keeper, such that the primary lever is rotated about the pivot pin and is brought to abut and overlay the hook section. A major problem with such arrangement, however, is that the toggle latch of this arrangement requires a relatively high profile and has the drawbacks inherent in such under-center configuration.

Furthermore, in both of the above-described arrangements the primary lever of the latch can be jostled during operation of the latching mechanism which can cause unwanted releasing thereof, or can result in damage to the latching mechanism. As well, an unprotected mechanism can present a dangerous obstruction to passers-by.

SUMMARY OF THE INVENTION

It is therefore an object of the present invention to provide a low profile over-center adjustable latch.

It is an additional object of the present invention to provide a low profile over-center adjustable latch which can assume a safe low profile in an open or closed condition.

The present invention relates to an improved low profile toggle latch configuration for use on a container having container lid and body sections. The toggle latch of the invention comprises a latch arm having an internally threaded latch barrel nut for adjustable threaded cooperation with a threaded latch draw bolt. The latch draw bolt is pivotally coupled to a latch handle. The latch handle comprises projecting sidewalls and a projecting grip. The latch handle operates as a primary lever arm and is pivoted at a mounting stirrup assembly by means of flanged bearing surfaces of the latch handle. These flanged bearing surfaces cooperate with respective mounting journals defined in the protecting elements of the mounting stirrup assembly. The mounting stirrup assembly is mounted in such a manner as to provide sufficient offset of the invention to allow for any overhang of the container lid.

DESCRIPTION OF THE DRAWINGS

The invention will be more clearly understood by reference to the following detailed description of a preferred embodiment thereof in conjunction with the accompanying drawings, in which.

DETAILED DESCRIPTION OF THE PREFERRED EMBODIMENT

Figure 1:
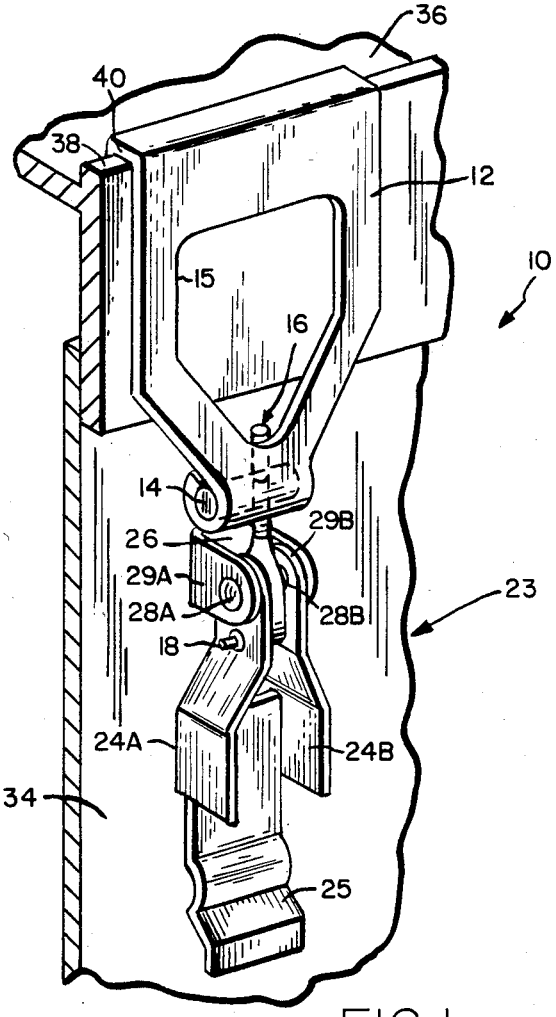
FIG. 1 is a left perspective view of the present invention affixed to a container shown in partial section.
Figure 2:
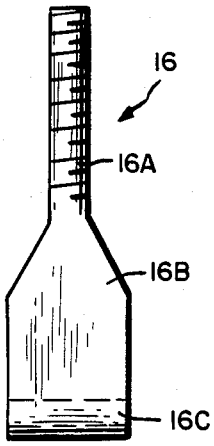
FIG. 2 is a plan view of an exemplary draw bolt of the present invention.

Referring now to FIG. 1, toggle latch assembly 10 is shown comprising a latch arm 12 cooperating with latch handle assembly 20 in a novel manner. Latch arm 12 comprises a hook section 40 and an integral latch barrel nut 14, the latter disposed for threaded cooperation with a threaded latch draw bolt 16. Also, the latch arm 12 defines an internal opening 15 in its broad face, as seen in FIG. 1. As seen in FIG. 2, latch draw bolt 16 comprises a threaded shaft 16A for cooperation with latch barrel nut 14, and an enlarged pivot end 16B. This enlarged pivot end 16B defines a transverse channel 16C therethrough.

Figure 3:
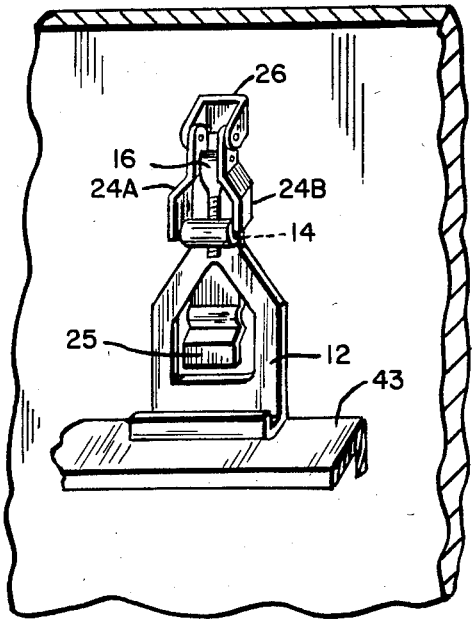
FIG. 3 is a right perspective view of the embodiment of FIG. 1 in stowed unlatched condition.

Referring to FIGS. 1 and 3, a latch pin 18 is shown inserted through transverse channel 16C while the pin 18 is mated in cooperating journals (unnumbered) defined in projecting sidewalls 24A, 24B of latch handle assembly 20. In this manner, latch draw bolt 16 is coupled to latch handle assembly 20.

Sidewalls 24A, 24B further define flanged bearing surfaces 28A, 28B, respectively, whose function is described below. Latch handle 20 further comprises a projecting grip 25, wherein projecting sidewalls 24A, 24B and projecting grip 25 cooperate with latch arm 12 to facilitate a low profile.

Projecting grip 25 protects the latch arm 12, when the latter is stowed in the unlatched condition shown in FIG. 3. More particularly, latch arm 12 mounts over projecting grip 25 such that projecting grip 25 extends through opening 15 of latch arm 12. As a result thereof, the latch arm 12 is protected from damage, and passers by are protected from contact with an unstowed, unprotected latch arm 12. Furthermore, where the configuration of projecting grip 25 is such that a frictional fit of it with latch arm 12 at opening 15 is achieved, then this arrangement will by virtue of such cooperation be able to better retain the latch in a stowed open position, as will further prevent damage to the latch and further prevent the open latch from acting as an unwanted and dangerous obstruction to the user.

Latch handle 20 functions as a primary lever arm and is pivoted at its flanged bearing surfaces 28A, 28B about journals defined in mounting stirrup 26. More particularly, mounting stirrup 26 comprises projecting elements 29A, 29B, each of which elements defines a respective mounting journal (unnumbered) for cooperation with a respective flange 28A, 28B. The mounting stirrup 26 is further comprised to provide sufficient offset of the toggle latch assembly 10 to allow for the overhang of the container lid.

The container to which the toggle latch assembly 10 is affixed in this embodiment comprises a container body 34 and a container lid 36. The container lid 36 further defines an optional flange 38. Flange 38 cooperates with a hooked end 40 of latch arm 12 to facilitate secure latching of container body 34 to container lid 36.

Figure 4:
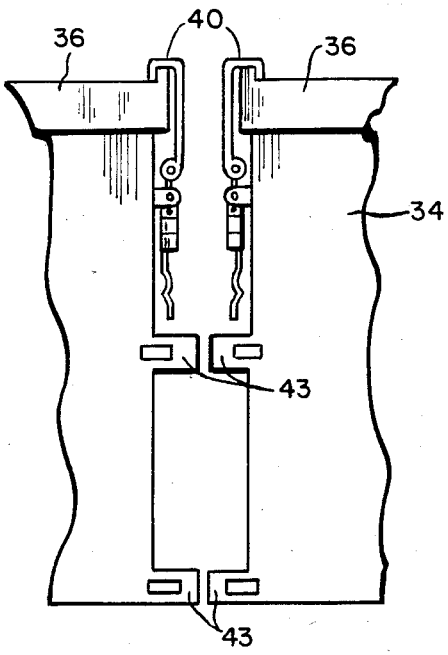
FIG. 4 is a partial side view of two containers incorporating the present invention.

Optional container flanges 43, shown in FIGS. 3 and 4 operate to enable adjacent storing of a multiplicity of like containers whereby the low profile toggle latch assembly 10 in either its latched or unlatched condition will not obstruct container stacking and yet crushing of the latch assembly is prevented.

In operation, container lid 36 is seated appropriately upon body 34. Latch arm 12 is swung up to abut the face of lid 36. The latch handle 20 is elevated by means of grip 25, pivoting about flanges 28A, 28B seated in respective journals defined in respective projecting elements 29A, 29B of stirrup 26. Upon such elevation, hook end 40 of latch arm 12 is seated over flange 38 of lid 36. Thereupon latch handle 20 is rotated downward (by means of grip 25) and is pressed toward container body 34 to latch the container shut.

At such time, the container lid and body should be appropriately latched. If the latch assembly is either too light or too loose, however, latch arm 12 may be appropriately rotated at barrel nut 14 about latch draw bolt 16 to loosen or tighten the toggle latch assembly 10 as desired.

In the unlatched condition, the latch arm 12 can be stored against the container body 34 by means of cooperation of grip 25 with the opening defined in latch arm 12.

While the present invention has been described in connection with rather specific embodiment thereof, it will be understood that many modifications and variations will be readily apparent to those of ordinary skill in the art and that this application is intended to cover any adaptation or variation thereof. Therefore, it is manifestly intended that this invention be only limited by the claims and the equivalents thereof.

What is claimed is:

1. A toggle latch apparatus, comprising:

a latch arm, said latch arm having a hook at one end thereof, a barrel nut located at the other end thereof, said barrel nut having a threaded orifice therethrough, and an opening of predetermined size intermediate said hook and said barrel nut;

a stirrup;

a latch handle assembly, said latch handle assembly having a pair of projecting side walls, said side walls being pivotally connected at one end thereof to said stirrup, a grip element interposed between said pair of side walls at the other end thereof, said grip element being deformed upward toward its outer end and dimensioned to mate with said opening in said latch arm in an unlatched condition of said latch arm, and wherein each of said side walls define a journal therethrough; and a draw bolt, said draw bolt including a threaded shaft adjacent one end thereof adjustably connecting said draw bolt to said threaded orifice in said barrel nut of said latch arm, said draw bolt further having a transverse pin hole adjacent the other end thereof, and a pivot pin traversing said pin hole and journalled in said journal of each of said side walls of said handle assembly in order for said latch arm to pivot with respect to said handle assembly.

2. The apparatus of claim 1, wherein each of said side walls further defines an orifice-defining flange and wherein said stirrup comprises first and second projecting elements, each of said projecting elements defining a journal therethrough, wherein each of said flanges cooperates with a respective one of said projecting elements of said stirrup.

3. The apparatus of claim 1 further comprising a container having a top and a base, said stirrup mounted to said base, said top defining a flange, said hooked end cooperating with said flange when latching the container closed.

4. A toggle latch, comprising:

a latch arm, said latch arm having a barrel nut located at one end thereof, and an opening of predetermined size in its face;

a stirrup, said stirrup having a pair of projecting elements;

a latch handle assembly, said latch handle assembly having a pair of projecting side walls, said projecting side walls being pivotally connected at one end thereof to said projecting elements of said stirrup, a grip element interposed between said pair of projecting side walls at the other end thereof, said grip element being dimensioned to mate with said opening in said face of said latch arm in the unlatched condition of said latch arm; and a draw bolt, said draw bolt being pivotally mounted at one end thereof to said pair of side walls of said latch handle assembly and said draw bolt being adjustably coupled at the other end thereof to said barrel nut of said latch arm to enable adjustment of the length of said arm;

whereby said latch arm is pivotable with respect to said latch handle assembly.

5. The toggle latch of claim 4, wherein said draw bolt defines a pin hole therethrough, said toggle latch further comprises a pivot pin, wherein said projecting side walls of said latch handle assembly each define an orifice therethrough, said pivot pin cooperating with said pin hole and said orifice for pivotally mounting said draw bolt to said latch handle assembly.

6. The toggle latch of claim 5, wherein said stirrup defines a journal through each of its projecting elements, and said assembly further defines a flange in each of its projecting sidewalls, said flanges operative as bearings in said journal of said stirrup for pivoting of said assembly.

* * * * *